US009173265B2

(12) United States Patent
Park et al.

(10) Patent No.: US 9,173,265 B2
(45) Date of Patent: Oct. 27, 2015

(54) LIGHT EMITTING DIODE DRIVING APPARATUS AND LIGHT EMITTING DIODE LIGHTING APPARATUS

(71) Applicant: SAMSUNG ELECTRO-MECHANICS CO., LTD., Suwon-Si, Gyeonggi-Do (KR)

(72) Inventors: Deuk Hee Park, Suwon-Si (KR); Chan Woo Park, Suwon-Si (KR); Yun Joong Lee, Suwon-Si (KR); Jong Tae Hwang, Suwon-Si (KR); Je Hyeon Yu, Suwon-Si (KR); Soo Hyun Moon, Suwon-Si (KR); Hye Jin Lee, Suwon-Si (KR); Chang Seok Lee, Suwon-Si (KR); Sang Hyun Cha, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/294,878

(22) Filed: Jun. 3, 2014

(65) Prior Publication Data

US 2015/0173149 A1 Jun. 18, 2015

(30) Foreign Application Priority Data

Dec. 17, 2013 (KR) ..... 10-2013-0157398

(51) Int. Cl.
*H05B 33/08* (2006.01)

(52) U.S. Cl.
CPC ..... *H05B 33/0851* (2013.01); *H05B 33/0824* (2013.01)

(58) Field of Classification Search
None
See application file for complete search history.

(56) References Cited

U.S. PATENT DOCUMENTS

| | | | | |
|---|---|---|---|---|
| 2011/0084619 | A1 | 4/2011 | Gray et al. | |
| 2011/0273103 | A1 | 11/2011 | Hong | |
| 2012/0319609 | A1* | 12/2012 | Choi et al. | 315/210 |
| 2013/0169160 | A1 | 7/2013 | Kim et al. | |
| 2013/0320868 | A1* | 12/2013 | Kim et al. | 315/186 |

FOREIGN PATENT DOCUMENTS

| | | | |
|---|---|---|---|
| EP | 2670219 | A2 | 12/2013 |
| JP | 2011-087298 | A | 4/2011 |
| KR | 10-0997050 | B1 | 11/2010 |
| KR | 2013-0017553 | A | 2/2013 |

OTHER PUBLICATIONS

Extended Search Report dated May 19, 2015 issued in European Patent Application No. 14170845.3.

* cited by examiner

*Primary Examiner* — Douglas W Owens
*Assistant Examiner* — Dedei K Hammond
(74) *Attorney, Agent, or Firm* — McDermott Will & Emery LLP

(57) ABSTRACT

There are provided a light emitting diode (LED) driving apparatus and an LED lighting apparatus, in which a common detection resistor detecting a current flowing in each LED is used. According to exemplary embodiments of the present disclosure, manufacturing costs and a circuit area may be reduced by commonly using a common detection resistor detecting a current flowing in each of the LEDs.

15 Claims, 4 Drawing Sheets

LIGHT EMITTING DIODE DRIVING APPARATUS AND LIGHT EMITTING DIODE LIGHTING APPARATUS

CROSS-REFERENCE TO RELATED APPLICATION

This application claims the benefit of Korean Patent Application No. 10-2013-0157398 filed on Dec. 17, 2013, with the Korean Intellectual Property Office, the disclosure of which is incorporated herein by reference.

BACKGROUND

The present disclosure relates to a light emitting diode (LED) driving apparatus for driving an LED and an LED lighting apparatus for driving an LED lighting element.

An LED is a semiconductor device formed to have a p-n junction structure to emit light due to the recombination of electrons and holes and is used in a range of fields in line with recent advances in semiconductor technology.

In particular, since LEDs have high efficiency and long lifespan and are environmentally friendly, as compared with existing light emitting devices; fields of application thereof are being extended.

In general, an LED may be driven by applying DC power having a level of a few volts due to the structural nature thereof, and thus, in general, in order to drive an LED with commercial alternating current (AC) power available domestically, commercially, industrially, or the like, an additional means is required.

In order to drive an LED with commercial AC power, an LED driving apparatus typically includes a rectifying circuit, an alternating current-direct current (AC-DC) converter, and the like.

However, a general AC-DC converter is relatively voluminous and may consume a large amount of power, such that the application of the general AC-DC converter to the LED driving apparatus severely offsets advantages of the LED such as high efficiency, a small packaging size, a long life span, or the like.

Thus, recently, research into a device able to directly drive an LED with AC power, without using an AC-DC converter, has been actively conducted.

In the case of an AC direct driving scheme of directly driving an LED with AC power, a smoothing capacitor is not used, and thus, an LED driving circuit is advantageous in terms of a lifespan, a size, and the like thereof.

In a case in which an LED is directly driven with AC power without using an AC-DC converter, a plurality of switches are connected to a plurality of LEDs, respectively, and a corresponding LED group is turned on and off to be driven according to a level of AC power.

Namely, in an LED driving circuit based on the AC direct driving scheme, an LED group may be controlled to be turned on and off according to a change in a voltage level of the AC power.

Meanwhile, in the LED driving apparatus based on the AC direct driving scheme, a turning on/off operation may be automatically adjusted by detecting a current flowing in an LED and controlling the current to follow a reference voltage, and here, since resistors are connected to individual LEDs, a circuit area and manufacturing costs are increased.

Patent Documents 1 and 2 do not employ a configuration for resolving limitations that a circuit area and manufacturing costs are increased due to resistors connected to respective LEDs.

RELATED ART DOCUMENT (Patent Document 1) Korean Patent No. 10-0997050
(Patent Document 2) Korean Patent Laid-Open Publication No. 2013-0017553

SUMMARY

An aspect of the present disclosure may provide an alternating current (AC) direct driving type light emitting diode (LED) driving apparatus and an LED lighting apparatus in which a common detection resistor detecting a current flowing in each LED is used.

According to an aspect of the present disclosure, a light emitting diode (LED) driving apparatus may include: a light emitting unit including a plurality of LEDs connected in series, the plurality of LEDs being turned on according to a voltage level of provided rectified power to emit light; a switching unit including a plurality of switches respectively corresponding to the plurality of LEDs, and providing a turn-on path for a corresponding LED among the plurality of LEDs according to the voltage level of the rectified power; a detecting unit including a detection resistor commonly connected to the plurality of switches, the detection resistor detecting currents flowing in the LEDs turned on by the plurality of switches; and a driving unit including a plurality of drivers respectively driving the plurality of switches of the switching unit, the plurality of respective drivers driving the switches corresponding thereto by comparing detection voltages of the currents detected by the detecting unit with a plurality of preset reference voltages, and the plurality of respective drivers having different offset voltages set therein and adding the differently set offset voltages to the detection voltages.

The LED driving apparatus may further include a rectifying unit rectifying alternating current (AC) power and supplying the rectified AC power to the light emitting unit.

Each of the plurality of drivers may include a comparing unit including a first switch receiving the reference voltage to perform a switching operation and a second switch receiving the detection voltage to perform a switching operation, and comparing the reference voltage with the detection voltage; a first current mirroring unit mirroring a preset current flowing in a current source according to the switching operations of the first and second switches; and a second current mirroring unit connected to the first current mirroring unit in parallel to mirror a current flowing in the first current mirroring unit.

The offset voltages of the plurality of drivers may be respectively set to be different by setting a size of the second switch to be greater than that of the first switch.

The offset voltages of the plurality of drivers may be respectively set to be different by differentially setting sizes of transistors of the first mirroring unit.

The offset voltages of the plurality of drivers may be respectively set to be different by differentially setting sizes of transistors of the second mirroring unit.

The light emitting unit may include first to Nth (N is a natural number equal to or greater than 1) LEDs connected in series, the switching unit may include first to Nth (N is a natural number equal to or greater than 1) switches connected between cathodes of the respective first to Nth LEDs and the detection resistor, the driving unit may include first to Nth (N is a natural number equal to or greater than 1) drivers corresponding to the first to Nth switches in a one-to-one manner, comparing the detection voltages with the provided reference voltages, respectively, and providing switching control signals to the first to Nth switches, respectively, and offset voltages of the respective first to Nth drivers may have voltage levels in such a manner that a voltage level of an offset voltage of a subsequent driver is lower than that of an offset voltage of a previous driver, sequentially.

Reference voltages of the respective first to Nth drivers may have voltage levels in such a manner that a voltage level of a reference voltage of a subsequent driver is equal to or greater than that of a reference voltage of a previous driver, sequentially.

According to another aspect of the present disclosure, a light emitting diode (LED) lighting apparatus may include: a rectifying unit rectifying alternating current (AC) power; a lighting unit including a plurality of LEDs connected in series, the plurality of LEDs being turned on according to a voltage level of the power rectified by the rectifying unit to emit light; a switching unit including a plurality of switches respectively corresponding to the plurality of LEDs, and providing a turn-on path for a corresponding LED among the plurality of LEDs according to the voltage level of the rectified power; a detecting unit including a detection resistor commonly connected to the plurality of switches, the detection resistor detecting currents flowing in the LEDs turned on by the plurality of switches; and a driving unit including a plurality of drivers respectively driving the plurality of switches of the switching unit, the plurality of respective drivers driving the switches corresponding thereto by comparing detection voltages of the currents detected by the detecting unit with a plurality of preset reference voltages, and the plurality of respective drivers having different offset voltages set therein and adding the differently set offset voltages to the detection voltages.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
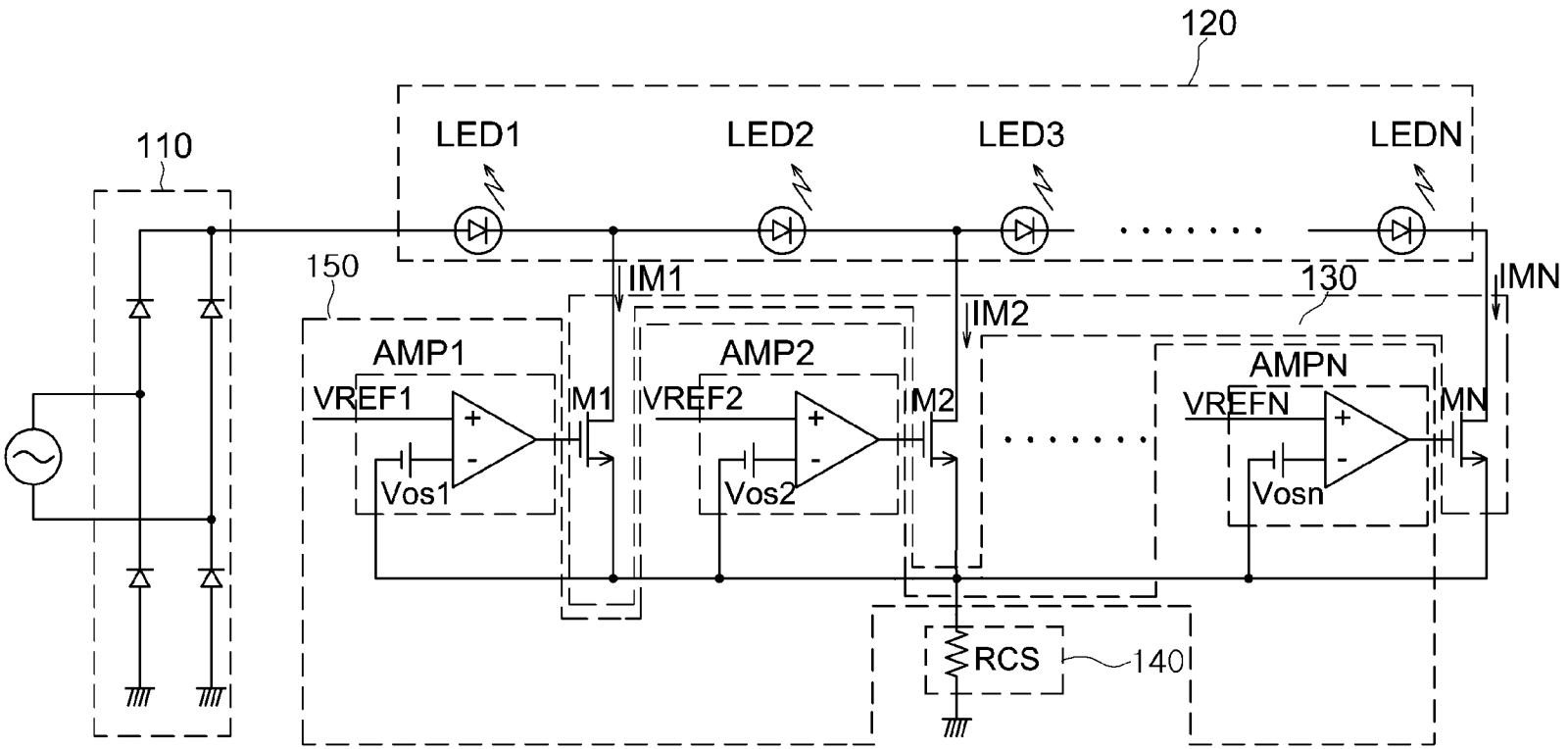
FIG. 1 is a circuit diagram schematically illustrating a light emitting diode (LED) driving apparatus (LED lighting apparatus) according to an exemplary embodiment of the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

Throughout the drawings, the same or like reference numerals will be used to designate the same or like elements.

FIG. 1 is a circuit diagram schematically illustrating a light emitting diode (LED) driving apparatus (LED lighting apparatus) according to an exemplary embodiment of the present disclosure.

Referring to FIG. 1, a light emitting diode (LED) driving apparatus (LED lighting apparatus) according to an exemplary embodiment of the present disclosure may include a rectifying unit 110, a light emitting unit (a lighting unit) 120, a switching unit 130, a detecting unit 140, and a driving unit 150.

The rectifying unit 110 may be configured of a bridge diode and may full-wave rectify alternating current (AC) power and supply the rectified power to the light emitting unit (lighting unit) 120.

The light emitting unit (lighting unit) 120 may include a plurality of LEDs LED1, LED2, LED3, . . . , LEDN connected in series, and each of the LEDs may be a single LED unit or a plurality of LED units.

The first to Nth (N is a natural number equal to or greater than 1) LEDs LED1, LED2, LED3, . . . , LEDN may be connected in series and turned on according to a voltage level of the power rectified by the rectifying unit 110 to emit light.

The switching unit 130 may include a plurality of switches M1, M2, . . . , MN. The first to Nth (N is a natural number equal to or greater than 1) switches M1, M2, . . . , MN may be connected between cathodes of the first to Nth (N is a natural number equal to or greater than 1) LEDs LED1, LED2, LED3, . . . , LEDN and the detecting unit 140 and switched on according to the voltage level of the power rectified by the rectifying unit 110, such that the LEDs corresponding to the switches may be turned on to thereby provide paths allowing currents IM1, IM2 and IMN to flow therealong.

The detecting unit 140 may include a common detection resistor RCS, and the single common detection resistor RCS may be connected to a ground and each of the first to Nth switches M1, M2, . . . , MN.

The driving unit 150 may include first to Nth (N is a natural number equal to or greater than 1) drivers AMP1, AMP2, . . . , AMPN corresponding to the first to Nth switches M1 to MN, respectively.

The first to Nth drivers AMP1 to AMPN may compare respective detection voltages detected by the common detection resistor RCS with preset first to Nth (N is a natural number equal to or greater than 1) reference voltages VREF1, VREF2, . . . , VREFN, and switch the first to Nth switches M1, M2, . . . , MN on or off so that the respective detection voltages follows the reference voltages corresponding thereto.

In detail, the first driver AMP1 may compare a detection voltage with the first reference voltage VREF1 and switch the first switch M1 on, and when the voltage level of the rectified power is increased from zero voltage to a turn-on voltage or more of the first LED LED1, the first LED LED1 may be turned on and a conduction path is provided by the switched-on first switch M1 to allow a current IM1 to flow in the LED, and thus, the first LED LED1 emits light.

Thereafter, when the voltage level of the rectified power is increased to be equal to or greater than a turn-on voltage of the first and second LEDs LED1 and LED2, an operation of the first driver AMP1 is stopped and the second driver AMP2 may compare a detection voltage with the second reference voltage VREF2 and switch the second switch M2 on to allow a current IM2 to flow in the LEDs, and thus, the first and second LEDs LED1 and LED2 emit light.

The first LED, the first and second LEDs, and the first to Nth LEDs may be turned on in the order described above, and when the voltage level of the rectified power is lowered from a maximum value of the voltage level, the LEDs may be sequentially turned off from the Nth LED to the first LED.

Meanwhile, the common detection resistor RCS is used, a defect in which the same detection voltage is applied to each of the drivers may be caused.

In order to avoid the defect, an offset voltage may be set in each driver. In detail, different offset voltages may be set for respective drivers, and in more detail, offset voltages of the first to Nth drivers may be set to be sequentially decreased.

In addition, respective reference voltages may have the same voltage level or greater.

The reference voltages and offset voltages may be expressed by Expression 1 below.

$$VREF1 \leq VREF2 \leq \ldots \leq VREFN$$

$$Vos1 > Vos2 > \ldots > Vosn \qquad \text{[Expression 1]}$$

Figure 2:
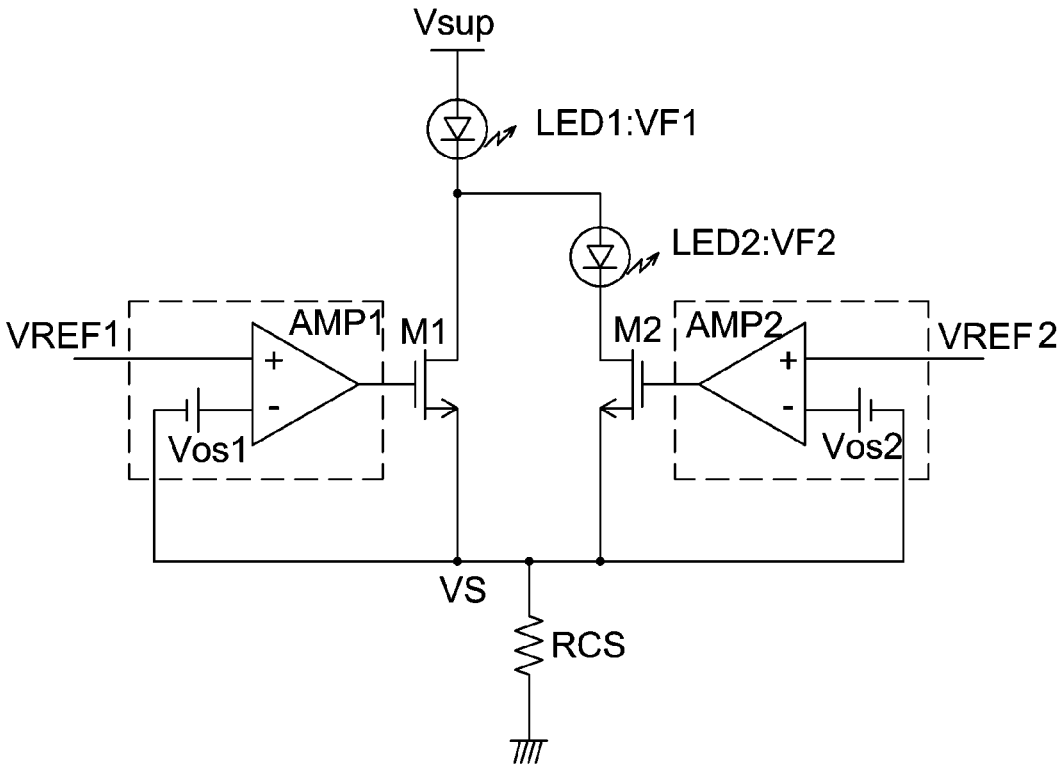
FIG. 2 is a circuit diagram schematically illustrating an example of an LED driving apparatus (LED lighting apparatus) according to an exemplary embodiment of the present disclosure.

FIG. 2 is a circuit diagram schematically illustrating an example of an LED driving apparatus (LED lighting apparatus) according to an exemplary embodiment of the present disclosure.

Referring to FIG. 2, an LED driving apparatus (LED lighting apparatus) according to an exemplary embodiment of the present disclosure may include first and second LEDs LED1 and LED2, and first and second switches M1 and M2 and first and second drivers AMP1 and AMP2 to operate the first and second LEDs LED1 and LED2.

As described above, when a voltage level of rectified power Vsup is equal to or lower than a turn-on voltage VF1 of the first LED LED1, the first LED LED1 is turned off and the current M1 does not flow. Accordingly, a detection voltage Vs is 0V and an input of a negative (−) terminal of the first driver AMP1 is Vs+Vos1, resulting in 0V+Vos1. However, since a voltage level input to the negative (−) terminal of the first driver AMP1 is lower than that of the first reference voltage VREF1 input to a positive (+) terminal thereof, and thus, an output from the first driver AMP1 has a maximum output voltage to switch the first switch M1 on.

In the case that the voltage level of the rectified power Vsup is increased to be equal to or greater than a turn-on voltage of the first LED LED1, the first LED LED1 may be turned and the first driver AMP1 may compare the detection voltage Vs with the first reference voltage VREF1 and adjust an output thereof such that a voltage level of the detection voltage Vs follows the first reference voltage VREF1, to thereby adjust the current IM1 flowing in the LED according to a switching-on operation of the first switch M1.

This may be expressed by Expression 2 below.

$$VREF1 = RCS * IM1 + Vos1$$

$$IM1 = (VREF1 - Vos1)/RCS \qquad \text{[Expression 2]}$$

Thereafter, when the voltage level of the rectified power Vsup is increased to be equal to or greater than the turn-on voltage of the first and second LEDs LED1 and LED2, the operation of the first driver AMP1 may be stopped and the second driver AMP2 may compare the detection voltage Vs with the second reference voltage VREF2 and adjust an output thereof such that the voltage level of the detection voltage Vs follows the second reference voltage VREF1 to thereby adjust the current IM1 flowing in the LED according to a switching-on operation of the second switch M2.

In detail, the second offset voltage Vos2 may have a voltage level higher than that of the first offset voltage Vos1, and when the second driver AMP2 operates, the detection voltage Vs may become VREF2−Vos2. Accordingly, an equivalent voltage applied to the negative (−) terminal of the first driver AMP1 is VREF1−Vos2+Vos1, and here, VREF1=VREF2 and Vos1−Vos2>0. Thus, the voltage applied to the negative (−) terminal of the first driver AMP1 is increased to be greater than the first reference voltage VREF1 to lower a voltage level of a signal output from the first driver AMP1, whereby the first switch M1 may be switched off.

As described above, in order to facilitate the description of an offset voltage, the LED driving apparatus (LED lighting apparatus) according to an exemplary embodiment of the present disclosure may have the first and second light emitting diodes LED1 and LED2 and the first and second switch M1 and M2 and the first and second drivers AMP1 and AMP2 to operate the first and second LEDS LED1 and LED2, but the number of the components is not limited thereto. Also, as for operations of the first to Nth switches M1 to MN, the first to Nth LEDs LED1 to LEDN, and the first to Nth drivers AMP1 to AMPN, it can be seen that, the first LED LED1, the first and second LEDs LED1 and LED2, and the first to Nth LEDs LED1 to LEDN are also turned on based on the descriptions illustrated in FIG. 2, and when the voltage level of the rectified power is lowered from the maximum value of the voltage level, the LEDs may be sequentially turned off from the Nth LED to the first LED.

Figure 3:
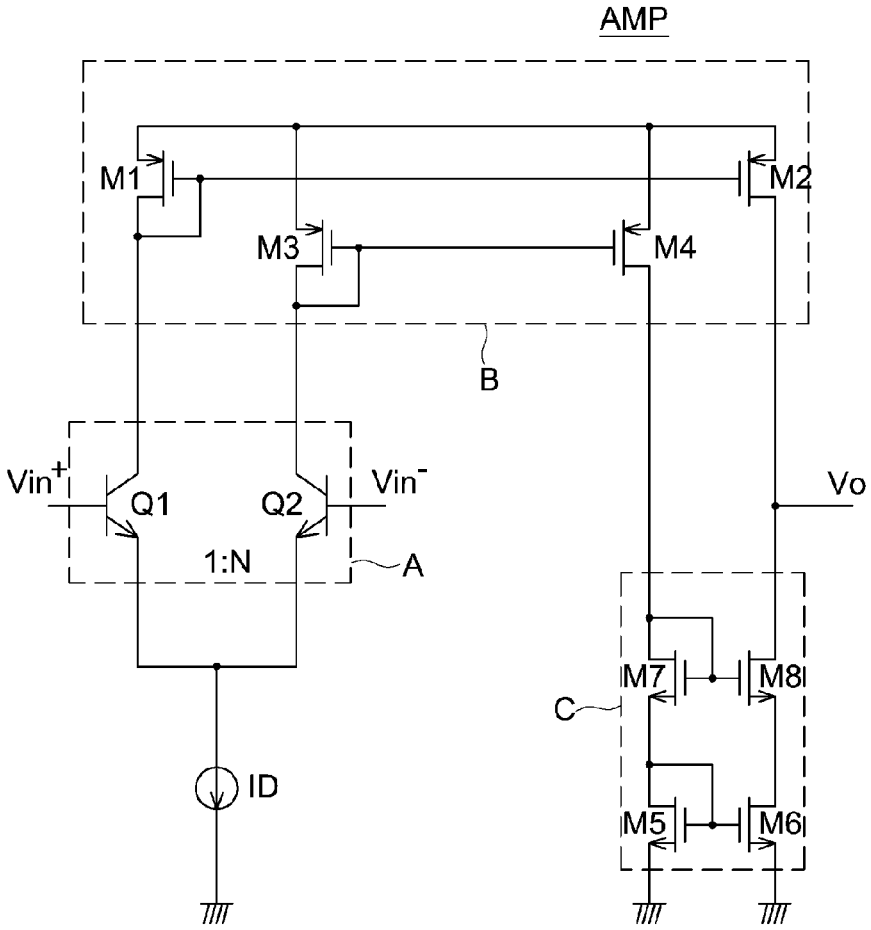
FIG. 3 is a circuit diagram schematically illustrating a driver employed in an LED driving apparatus (LED lighting apparatus) according to an exemplary embodiment of the present disclosure.

FIG. 3 is a circuit diagram schematically illustrating a driver employed in an LED driving apparatus (LED lighting apparatus) according to an exemplary embodiment of the present disclosure.

Referring to FIG. 3, a driver AMP employed in an LED driving apparatus (LED lighting apparatus) according to the exemplary embodiment of the present disclosure may include a comparing unit A, a first current mirroring unit B, and a second current mirroring unit C.

The comparing unit A may include first and second transistors Q1 and Q2 receiving voltage levels input to a negative (−) terminal and a positive (+) terminal of the driver AMP, respectively, and the first and second transistors Q1 and Q2 may perform switching operations according to the voltage levels input to the negative (−) terminal and the positive (+) terminal to compare the voltage levels. In this case, offset voltages may be set by varying a size or area ratio of the first and second transistors Q1 and Q2. The first and second transistors Q1 and Q2 may be variously configured and for example, each of the first and second transistors Q1 and Q2 may be a bipolar junction transistor (BJT), a field-effect transistor (FET), or the like.

For example, offset voltages may be set according to the size or area ratio of the first and second transistors Q1 and Q2 as illustrated in Table below.

TABLE

| Size ratio N | Offset (mV) |
|---|---|
| 1 | 0 |
| 2 | 18 |
| 3 | 28.6 |
| 4 | 36 |
| 5 | 41.8 |
| 6 | 46.6 |
| 7 | 50.6 |

A current source ID may provide a preset current. The first current mirroring unit B may mirror currents flowing during the switching of the first and second transistors Q1 and Q2, and a current flowing in a first transistor M1 may be mirrored to a second transistor M2, and a current flowing in a third transistor M3 may be mirrored to a fourth transistor M4.

Similarly, offset voltages may be set by varying a size or area ratio between the first and second transistors M1 and M2 or between the third and fourth transistors M3 and M4.

The second current mirroring unit C may include fifth to eighth transistors M5, M6, M7, and M8. Currents flowing in the fifth and seventh transistors M5 and M7 may be mirrored to the sixth and eighth transistors M6 and M8, and an output signal Vo of the driver MP may be output from a node between the second transistor M2 and the eighth transistor M.

Similarly, offset voltages may be set by varying a size or area ratio of the fifth and sixth transistors M5 and M6 or the seventh and eighth transistors M7 and M8.

Figure 4:
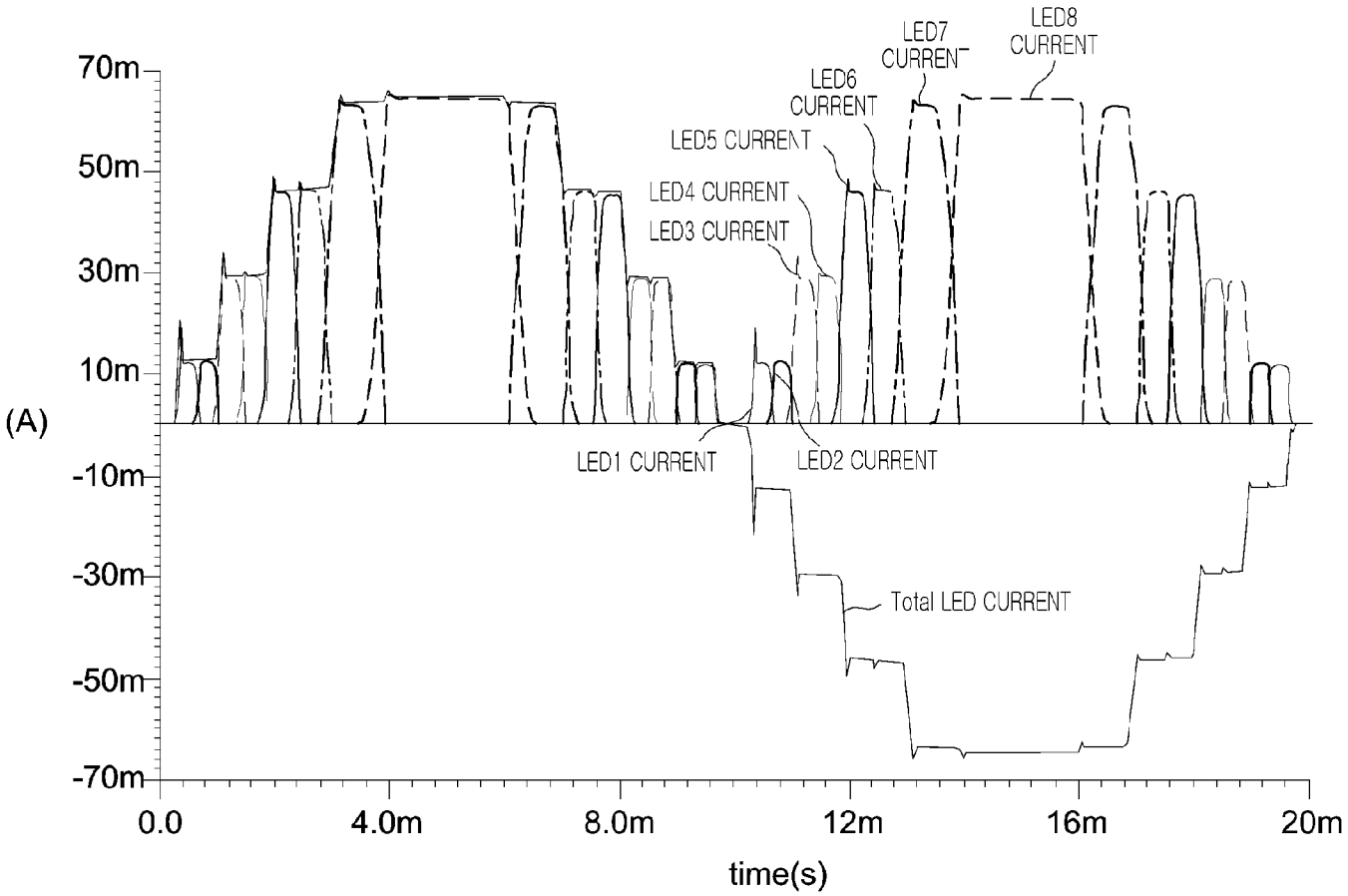
FIG. 4 is a graph illustrating current waveforms of respective LEDs of the LED driving apparatus (LED lighting apparatus) according to an exemplary embodiment of the present disclosure.

FIG. 4 is a graph illustrating current waveforms of respective LEDs of the LED driving apparatus (LED lighting apparatus) according to an exemplary embodiment of the present disclosure.

Referring to FIG. 4, in a case in which the LED driving apparatus (LED lighting apparatus) according to an exemplary embodiment of the present disclosure includes eight LEDs LED1 to LED8, it can be seen that, even when a common detection resistor is used, the LEDs normally operate according to a voltage level of rectified power by differentially setting offset voltages.

As set forth above, according to exemplary embodiments of the present disclosure, manufacturing costs and a circuit area may be reduced by commonly using a common detection resistor detecting a current flowing in each of the LEDs.

While exemplary embodiments have been shown and described above, it will be apparent to those skilled in the art that modifications and variations could be made without departing from the spirit and scope of the present disclosure as defined by the appended claims.

What is claimed is:

1. A light emitting diode (LED) driving apparatus comprising:

a light emitting unit including a plurality of LEDs connected in series, the plurality of LEDs being turned on according to a voltage level of provided rectified power to emit light;

a switching unit including a plurality of switches respectively corresponding to the plurality of LEDs, and providing a turn-on path for a corresponding LED among the plurality of LEDs according to the voltage level of the rectified power;

a detecting unit including a detection resistor commonly connected to the plurality of switches, the detection resistor detecting currents flowing in the LEDs turned on by the plurality of switches; and a driving unit including a plurality of drivers respectively driving the plurality of switches of the switching unit, the plurality of respective drivers driving the switches corresponding thereto by comparing detection voltages of the currents detected by the detecting unit with a plurality of preset reference voltages, and the plurality of respective drivers having different preset voltages set therein and adding the differently set preset voltages to the detection voltages.

2. The LED driving apparatus of claim 1, further comprising a rectifying unit rectifying alternating current (AC) power and supplying the rectified AC power to the light emitting unit.

3. A light emitting diode (LED) driving apparatus comprising:

a light emitting unit including a plurality of LEDs connected in series, the plurality of LEDs being turned on according to a voltage level of provided rectified power to emit light;

a switching unit including a plurality of switches respectively corresponding to the plurality of LEDs, and providing a turn-on path for a corresponding LED among the plurality of LEDs according to the voltage level of the rectified power;

a detecting unit including a detection resistor commonly connected to the plurality of switches, the detection resistor detecting currents flowing in the LEDs turned on by the plurality of switches; and a driving unit including a plurality of drivers respectively driving the plurality of switches of the switching unit, the plurality of respective drivers driving the switches corresponding thereto by comparing detection voltages of the currents detected by the detecting unit with a plurality of preset reference voltages, and the plurality of respective drivers having different preset voltages set therein and adding the differently set preset voltages to the detection voltages, wherein each of the plurality of drivers includes:

a comparing unit including a first switch receiving the reference voltage to perform a switching operation and a second switch receiving the detection voltage to perform a switching operation, and comparing the reference voltage with the detection voltage;

a first current mirroring unit mirroring a preset current flowing in a current source according to the switching operations of the first and second switches; and a second current mirroring unit connected to the first current mirroring unit in parallel to mirror a current flowing in the first current mirroring unit.

4. The LED driving apparatus of claim 3, wherein the preset voltages of the plurality of drivers are respectively set to be different by setting a size of the second switch to be greater than that of the first switch.

5. The LED driving apparatus of claim 3, wherein the preset voltages of the plurality of drivers are respectively set to be different by differentially setting sizes of transistors of the first mirroring unit.

6. The LED driving apparatus of claim 3, wherein the preset voltages of the plurality of drivers are respectively set to be different by differentially setting sizes of transistors of the second mirroring unit.

7. The LED driving apparatus of claim 1, wherein the light emitting unit includes first to Nth (N is a natural number equal to or greater than 1) LEDs connected in series, the switching unit includes first to Nth (N is a natural number equal to or greater than 1) switches connected between cathodes of the respective first to Nth LEDs and the detection resistor, the driving unit includes first to Nth (N is a natural number equal to or greater than 1) drivers corresponding to the first to Nth switches in a one-to-one manner, comparing the detection voltages with the provided reference voltages, respectively, and providing switching control signals to the first to Nth switches, respectively, and preset voltages of the respective first to Nth drivers have voltage levels in such a manner that a voltage level of preset voltage of a subsequent driver is lower than that of preset voltage of a previous driver, sequentially.

8. The LED driving apparatus of claim 7, wherein reference voltages of the respective first to Nth drivers have voltage levels in such a manner that a voltage level of a reference voltage of a subsequent driver is equal to or greater than that of a reference voltage of a previous driver, sequentially.

9. A light emitting diode (LED) lighting apparatus comprising:

a rectifying unit rectifying alternating current (AC) power;

a lighting unit including a plurality of LEDs connected in series, the plurality of LEDs being turned on according to a voltage level of the power rectified by the rectifying unit to emit light;

a switching unit including a plurality of switches respectively corresponding to the plurality of LEDs, and providing a turn-on path for a corresponding LED among the plurality of LEDs according to the voltage level of the rectified power;

a detecting unit including a detection resistor commonly connected to the plurality of switches, the detection resistor detecting currents flowing in the LEDs turned on by the plurality of switches; and a driving unit including a plurality of drivers respectively driving the plurality of switches of the switching unit, the plurality of respective drivers driving the switches corresponding thereto by comparing detection voltages of the currents detected by the detecting unit with a plurality of preset reference voltages, and the plurality of respective drivers having different preset voltages set therein and adding the differently set preset voltages to the detection voltages.

10. The light emitting diode (LED) lighting apparatus of claim 9, wherein each of the plurality of drivers includes:

a comparing unit including a first switch receiving the reference voltage to perform a switching operation and a second switch receiving the detection voltage to perform a switching operation, and comparing the reference voltage with the detection voltage;

a first current mirroring unit mirroring a preset current flowing in a current source according to the switching operations of the first and second switches; and a second current mirroring unit connected to the first current mirroring unit in parallel to mirror a current flowing in the first current mirroring unit.

11. The LED lighting apparatus of claim 10, wherein the preset voltages of the plurality of drivers are respectively set to be different by setting a size of the second switch to be greater than that of the first switch.

12. The LED lighting apparatus of claim 10, wherein the preset voltages of the plurality of drivers are respectively set to be different by differentially setting sizes of transistors of the first mirroring unit.

13. The LED lighting apparatus of claim 10, wherein the preset voltages of the plurality of drivers are respectively set to be different by differentially setting sizes of transistors of the second mirroring unit.

14. The LED lighting apparatus of claim 9, wherein the lighting unit includes first to Nth (N is a natural number equal to or greater than 1) LEDs connected in series, the switching unit includes first to Nth (N is a natural number equal to or greater than 1) switches connected between cathodes of the respective first to Nth LEDs and the detection resistor, the driving unit includes first to Nth (N is a natural number equal to or greater than 1) drivers corresponding to the first to Nth switches in a one-to-one manner, comparing the detection voltages with the provided reference voltages, respectively, and providing switching control signals to the first to Nth switches, respectively, and preset voltages of the respective first to Nth drivers have voltage levels in such a manner that a voltage level of an offset voltage of a subsequent driver is lower than that of an offset voltage of a previous driver, sequentially.

15. The LED lighting apparatus of claim 14, wherein reference voltages of the respective first to Nth drivers have voltage levels in such a manner that a voltage level of a reference voltage of a subsequent driver is equal to or greater than that of a reference voltage of a previous driver, sequentially.

* * * * *